US009894940B2

(12) United States Patent
Pulliam et al.

(10) Patent No.: US 9,894,940 B2
(45) Date of Patent: Feb. 20, 2018

(54) APPARATUS AND METHOD OF MULTI-SECTIONAL BRA ASSEMBLY

(71) Applicants: Dawn Pulliam, Greenbelt, MD (US); Tomika Pitt, Greenbelt, MD (US)

(72) Inventors: Dawn Pulliam, Greenbelt, MD (US); Tomika Pitt, Greenbelt, MD (US)

( * ) Notice: Subject to any disclaimer, the term of this patent is extended or adjusted under 35 U.S.C. 154(b) by 0 days.

(21) Appl. No.: 15/338,912

(22) Filed: Oct. 31, 2016

(65) Prior Publication Data

US 2017/0119064 A1 May 4, 2017

Related U.S. Application Data

(60) Provisional application No. 62/247,987, filed on Oct. 29, 2015.

(51) Int. Cl.

| | |
|---|---|
| ***A41C 3/00*** | (2006.01) |
| ***A41F 1/00*** | (2006.01) |
| ***A41F 15/00*** | (2006.01) |
| ***A41C 3/06*** | (2006.01) |

(52) U.S. Cl.

CPC ..... *A41C 3/0028* (2013.01); *A41C 3/0007* (2013.01); *A41C 3/0071* (2013.01); *A41C 3/06* (2013.01); *A41F 1/006* (2013.01); *A41F 15/002* (2013.01)

(58) Field of Classification Search

CPC ..... A41C 3/065; A41C 3/0061; A41C 3/0071; A41C 3/0092; A41C 3/0028

USPC ..... 450/81, 88, 86

See application file for complete search history.

(56) References Cited

U.S. PATENT DOCUMENTS

| | | | | |
|---|---|---|---|---|
| 3,311,112 A * | 3/1967 | Murray | A41F 1/006 | 450/1 |
| 3,826,266 A * | 7/1974 | Alpert | A41C 3/0071 | 2/73 |
| 6,155,906 A * | 12/2000 | May | A41F 15/002 | 450/1 |
| 6,179,687 B1 * | 1/2001 | Lee | A41F 1/006 | 2/67 |
| 6,186,861 B1 * | 2/2001 | Flaherty | A41F 15/002 | 450/1 |
| 6,283,821 B1 * | 9/2001 | Wang | A41F 15/002 | 2/311 |
| D578,277 S * | 10/2008 | Lung | D2/706 | |
| 7,648,408 B2 * | 1/2010 | Lung | A41C 3/0071 | 2/336 |

(Continued)

*Primary Examiner* — Gloria Hale

(74) *Attorney, Agent, or Firm* — Maier & Maier, PLLC

(57) ABSTRACT

A multi-sectional bra assembly and method of use may be provided. In one exemplary embodiment, the bra assembly may include a breast support piece formed by a pair of breast support cups and adjacent side panels. A first and second back strap component may be releasably connected to the side panels via a first set of attachment elements located at the periphery of each side panel and at a first end of each back strap component. Back strap components may also be releasably connected to one another via a second set of attachment elements located at a second end of each back strap component. The breast support piece and back strap components may further include shoulder strap receiving elements to which detachable shoulder strap components may be secured. A plurality of back and shoulder strap variations may be adjustable and interchangeable about the breast support piece.

18 Claims, 6 Drawing Sheets

(56) References Cited

U.S. PATENT DOCUMENTS

| | | | | |
|---|---|---|---|---|
| 7,677,952 | B2 * | 3/2010 | Wooley | A41C 3/065 450/81 |
| D722,741 | S * | 2/2015 | Garcia | D2/708 |
| 2009/0093190 | A1 * | 4/2009 | Wooley | A41C 3/065 450/41 |
| 2009/0258572 | A1 * | 10/2009 | Chayo | A41C 3/0028 450/39 |
| 2012/0135667 | A1 * | 5/2012 | Chan | A41C 3/0092 450/58 |
| 2012/0220193 | A1 * | 8/2012 | Thompson | A41C 3/0064 450/93 |
| 2013/0084776 | A1 * | 4/2013 | Walsh | A41C 3/0028 450/57 |
| 2014/0057528 | A1 * | 2/2014 | Deal | A41C 3/065 450/38 |

* cited by examiner

APPARATUS AND METHOD OF MULTI-SECTIONAL BRA ASSEMBLY

CROSS-REFERENCE TO RELATED APPLICATIONS

This application claims priority from U.S. Provisional Patent Application No. 62/247,987, filed on Oct. 29, 2015, entitled "Apparatus and Method of Multi-Sectional Bra Assembly," the entire contents of which are hereby incorporated by reference.

BACKGROUND

A brassiere ("bra") is a woman's undergarment providing breast coverage and support. Over time, the evolution of the bra has reflected not only contemporary fashion but the changing ideals of femininity and decorum. While traditionally labelled "intimate apparel," the bra has developed into a fashion statement all of its own. Consequently, the fashion industry has manufactured increasingly more intricate and specialized designs suitable to wear with a variety of outer clothing. Variations not only include differences in ornamental appearance (e.g. color, print, fabric) but also modifications in structural formation (e.g., racerback, strapless, plunge).

While such a wide-ranging selection of design is currently on the market, bras are typically sold in fixed configurations, such that a customer may purchase a bra in a single style or for a particular functionality. Moreover, the structure and accessories offered for sale are overwhelmingly standardized to maximize retailer profitability. For example, the length and fabric of shoulder straps are predetermined by the band and cup size of the corresponding bra bodice. While it is well-known in the art to accommodate for an adjustment of fit, adjustable components do not allow for a change in outward appearance or structure of the bra itself.

One approach to solving this problem is presented in U.S. Pat. No. 6,517,409, entitled "Bra with straps for matching clothing." This patent describes a bra having a plurality of straps that can be interchanged so that the straps match clothing with which the bra is worn. However, the body portion of the bra is set in a fixed configuration, such that versatility may only be accomplished through the exchange of shoulder strap components.

Accordingly, there is a need for a new and improved bra that remedies the deficiencies inherent in the prior art. There is a need for a bra that allows for greater versatility in wear.

SUMMARY

A multi-sectional bra assembly and method of use may be provided. The present disclosure may overcome the deficiencies of the prior art by allowing a user to customize the style, color, and configuration of various strap components within the bra assembly.

In one exemplary embodiment, the bra assembly may include a breast support piece formed by a pair of breast support cups and adjacent side panels. A first and second back strap component may be releasably connected to the side panels via a first set of attachment elements located at the periphery of each side panel and at a first end of each back strap component. Back strap components may also be releasably connected to one another via a second set of attachment elements located at a second end of each back strap component. The breast support piece and back strap components may further include shoulder strap receiving elements to which detachable shoulder strap components may be secured.

The present disclosure may further contemplate a plurality of back and shoulder strap variations intended to be adjustable and interchangeable about the breast support piece.

In another exemplary embodiment, a method of coordinating and configuring various strap components within a bra assembly may be provided. In a first step of the method, a user may select a breast support piece having desired attributes, optionally assembling some or all parts of the breast support piece (such as, for example, attaching removable side panels) should there be a need to do so. In a next step, a user may select a plurality of back strap elements, which may, for example, be based on their fit and/or on some criteria (such as whether the back strap elements match an article of clothing, such as a dress, intended to be worn by the user). In a next step, the user may then couple the back strap elements to the breast support piece, for example using a plurality of connectors disposed on each of the side panels. In some exemplary embodiments, variable configurations of the back strap elements may be possible and may be selectable based on the chest girth of the user; for example, a user may select to attach the back strap elements to an outer set of connectors to achieve a larger chest girth or may select to attach the back strap elements to an inner set of connectors to achieve a smaller chest girth. Optionally, the user may then select one or more shoulder straps, which may be based on similar criteria to those used to select the back strap elements, and may adjust the shoulder straps as necessary before coupling them to the remainder of the bra assembly apparatus.

BRIEF DESCRIPTION OF THE FIGURES

Advantages of embodiments of the present invention will be apparent from the following detailed description of the exemplary embodiments. The following detailed description should be considered in conjunction with the accompanying figures.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
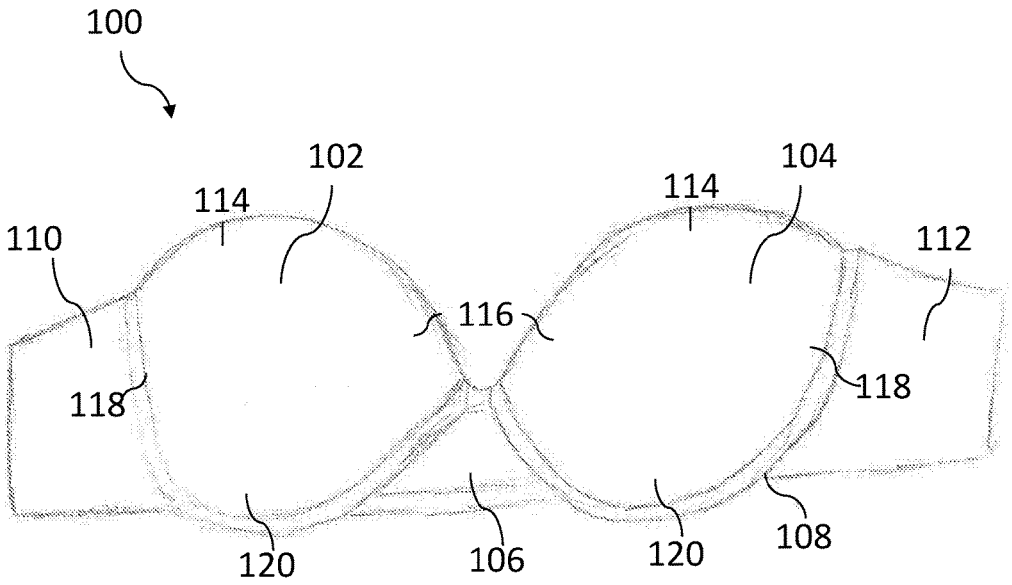
FIG. 1 shows an exemplary embodiment of a front perspective view of the breast support piece in accordance with the present disclosure.

FIG. 1 illustrates an exemplary embodiment of a front perspective view of the breast support piece in accordance with the present disclosure. The breast support piece 100 may include a first breast support cup 102 and second breast support cup 104 coupled together via an intermediary support band 106. In another embodiment, a first breast support cup and second breast support cup may be coupled at a discrete point, or alternatively, not directly coupled together at all.

Each breast support cup 102, 104 may have an upper portion 114, an inner side portion 116, an outer side portion 118, and a lower portion 120. The first and second support cups 102, 104 may include an underwire component 108 adapted to fit circumferentially around the lower portion 120 of each of the first and second support cup 102, 104. The underwire 108 may additionally extend along the intermediary support band 106, the inner side portion 116, and/or the outer side portion 118 of each of the first and second support cup 102, 104.

The breast support piece 100 may also include a first and second side panel 110, 112. The first side panel 110 may be attached to the first support cup 102 and the second side panel 112 may be attached to the second support cup 104. Alternatively, the side panels 110, 112 may be connected to the breast support piece 100 through an attachment with the underwire element 108.

Figure 2:
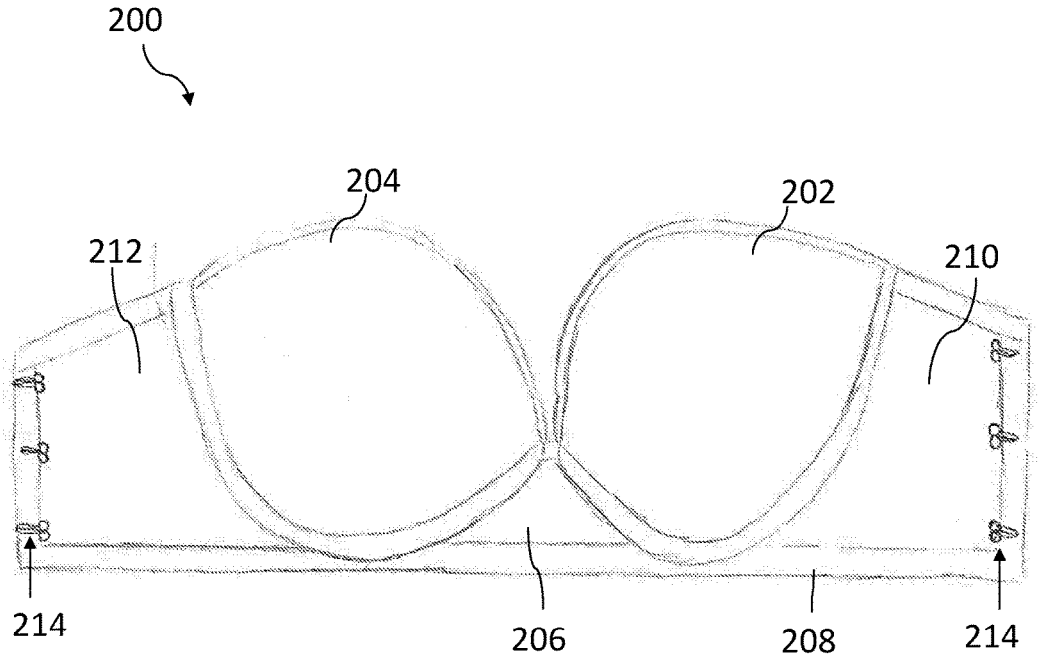
FIG. 2 shows an exemplary embodiment of a rear perspective view of the breast support piece in accordance with the present disclosure.

FIG. 2 illustrates an exemplary embodiment of a rear perspective view of the breast support piece of the present disclosure. The breast support piece 200 may include a pair of breast support cups 202, 204 with adjacent side panels 210, 212 and an intermediary support band 206. The side panels 210, 212 and intermediary support band 206 may be individually attached to the breast support cups 202, 204 within the breast support piece, or may optionally be constructed as a single component and attached as a unit.

A boundary 208 may be formed around the periphery of each component of the breast support piece 200 to maintain structural integrity of the garment, and/or provide an adhesive aspect. Alternatively, the boundary may be a through passage to which an underwire element may extend. The boundary may surround each component in its entirety, may occupy only some peripheral edges, or may alternatively be excluded from the design altogether. The breast support piece 200 and boundary 208 may be distinguished by any known fabrication method within in the art.

The first and second side panels 210, 212 may include a first set of attachments 214 located along an outer periphery of each first and second side panel 210, 212. The first set of attachment elements may be hook and eye closures 214 that enable an extendable, adjustable connection of the breast support piece 200 with back strap components (not shown). The attachment elements 214 may alternatively be composed of any suitable connectors known within the art, including but not limited to, semi-circular eyelets, snaps, buckles, flower slide clasps, garter grips, and so on.

Figure 3A:
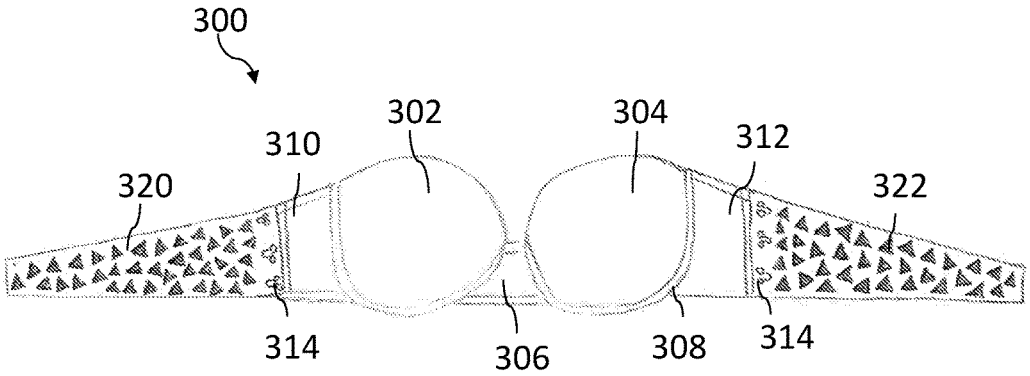
FIG. 3A shows an exemplary embodiment of a front perspective view of the bra assembly in accordance with the present disclosure.

FIG. 3A illustrates an exemplary embodiment of a front perspective view of the bra assembly in accordance with the present disclosure. The bra assembly 300 may include a breast support piece and back strap components 320, 322. The breast support piece may include first and second breast support cups 302, 304, an intermediary support band 306, an underwire component 308, and first and second side panels 310, 312. A first back strap 320 may be connected to the first side panel 310 and a second back strap 322 may be connected to the second side panel 312. This may be accomplished by a first set of attachment elements 314 located on an outer peripheral edge of each side panel 310, 312, and a complementary first set of attachment elements (not shown) located on a first end of each back strap 320, 322. The attachment elements may be visible from the outside of the bra assembly, or alternatively, may be hidden from view.

Figure 3B:
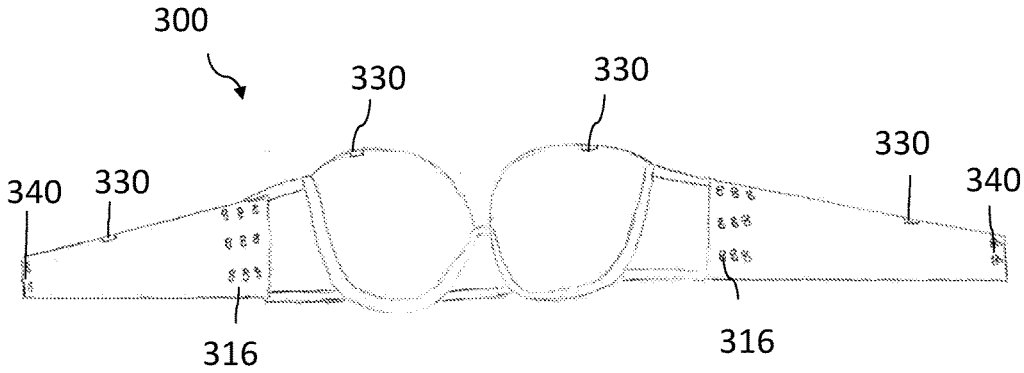
FIG. 3B shows an exemplary embodiment of a rear perspective view of the bra assembly in accordance with the present disclosure.

FIG. 3B illustrates an exemplary embodiment of a rear perspective view of the bra assembly in accordance with the present disclosure. As shown in FIG. 3A, the breast support piece may include first and second breast support cups, an intermediary support band, an underwire component, and first and second side panels. Each support cup may contain a shoulder strap receiving element 330 configured to receive one end of a shoulder strap (not shown). Each back strap may contain at least one row of complementary first set of attachment elements 316 located at a first end of each back strap, and may preferably contain at least two rows of attachment elements 316 configured to enable chest girth adjustment within the bra assembly. Each back strap may additionally contain a shoulder strap receiving element 330, located on an upper edge of the back strap and configured to receive one end of a shoulder strap. A second end of each back strap may contain a second set of attachment elements 340 capable of releasably connecting the back strap components to one another in a seamless closure.

Figure 4:
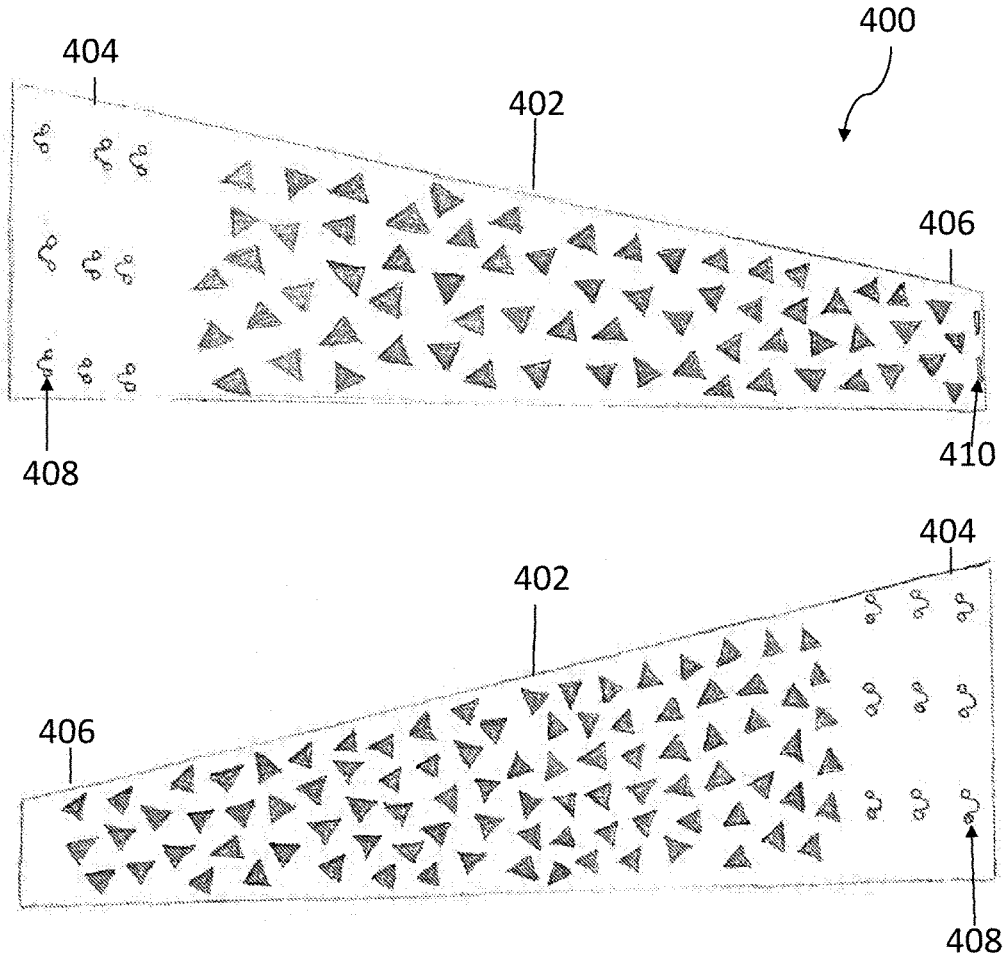
FIG. 4 shows an exemplary embodiment of back strap components in accordance with the present disclosure.

FIG. 4 illustrates an exemplary embodiment of a pair of back strap components in accordance with the present disclosure. Each back strap component 400 may be an elongated, rectangular member 402 having an interior side and an exterior side. The interior and exterior sides may be composed of a single material, or alternatively, may be made of separate materials of differing fabric, color, pattern, and/or design. In one exemplary embodiment, the back straps may be fabricated from a clear or transparent material such that they appear invisible when worn with a backless dress or cutout shirt. Alternatively, the back straps may be fabricated such that they match and/or accessorize outer clothing. A plurality of back strap components may be available for purchase, either individually, or in grouped units.

Each back strap may also have a first end 404 and a second end 406. The first end 404 of each back strap may be wider than the second end 406, or vice versa. At the first end 404 of each back strap 400, at least one row of a complementary first set of attachment elements 408 may be disposed such that each back strap may be releasably attachable to the breast support piece. A second set of attachment elements 410 may also be positioned at the second end 406 of each back strap. The second set of attachment elements 410 may be configured such that each back strap may be releasably connected to one another. The two sets of attachment elements 408, 410 may disposed on the interior side of each back strap, on the exterior side of each back strap, on alternating sides of each back strap, and/or optionally, on both sides of each back strap.

Figure 5:
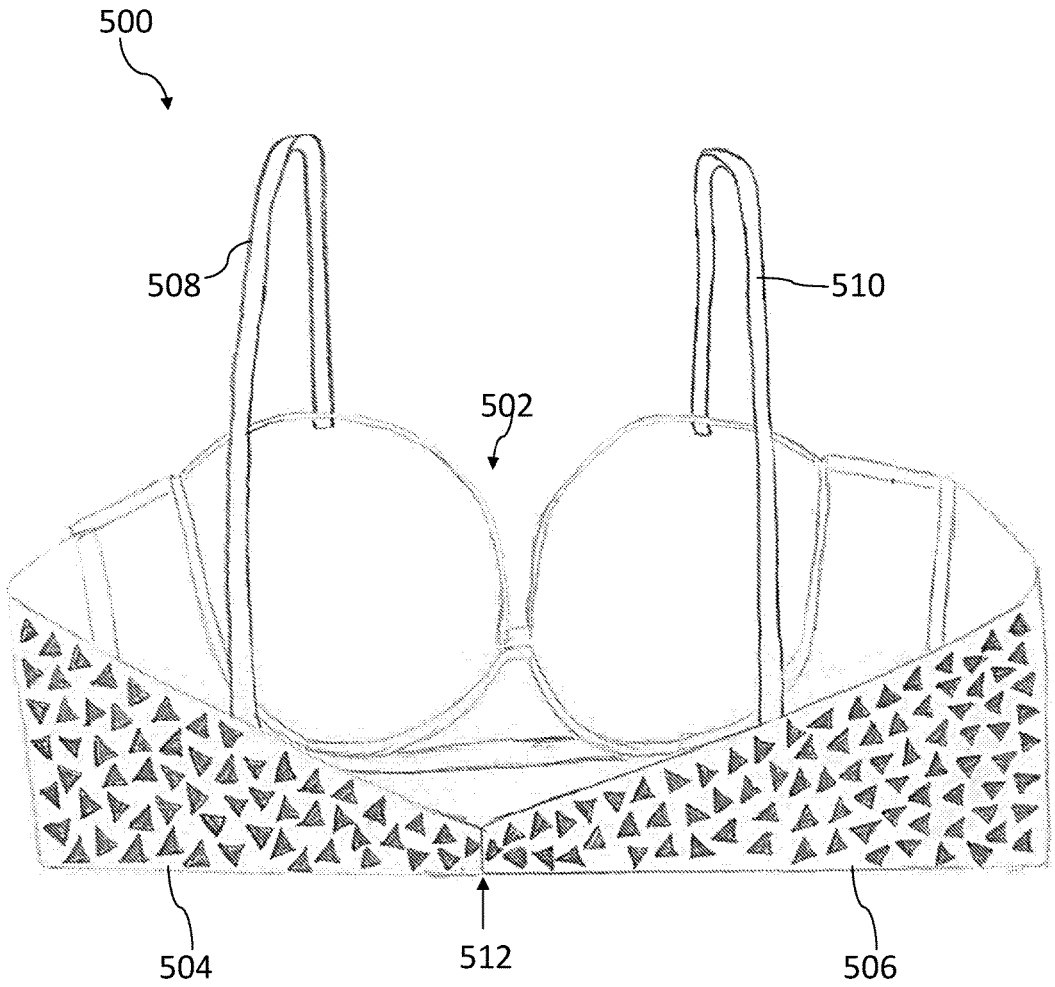
FIG. 5 shows an exemplary embodiment of a rear perspective view of the bra assembly in accordance with the present disclosure.

FIG. 5 illustrates an exemplary embodiment of a rear perspective view of the bra assembly in accordance with the present disclosure. The bra assembly 500 includes a breast support piece 502, a first back strap 504, a second back strap 506, a first shoulder strap 508, and a second shoulder strap 510. The first and second back straps 504, 506 may be configured such that a seamless closure 512 releasably connects the two strap components and may allow the bra to look more like clothing than an undergarment. Each of said first and second shoulder straps 508, 510 may also be releasably fastened to the breast support piece 502 and corresponding back straps 504, 506 via any known connector elements within the art. The shoulder straps 508, 510 may contain adjustment clips so that a user may alter the fit.

In one embodiment of the present disclosure, a user may preliminarily purchase a single breast support piece configured to be securable to and supportive of the user's breast area. The user may additionally purchase strap variations to be interchangeable about the breast support piece. Strap components may be offered with the purchase of a breast support piece, or may, alternatively, be offered entirely separate. A plurality of back strap and shoulder strap components may be available for individual and/or group purchase. Each strap may come in a variety of colors, prints, styles, fabrics, shapes, and so on. The present disclosure may allow a user to change the color and/or style of the bra assembly by simply attaching a new back and/or shoulder strap to the breast support piece and/or one of the other strap components.

In another embodiment, the bra assembly may allow a user to unhook and adjust the bra for comfort underneath the arm. The bra assembly may accent a user's outfit, may be used as an accessory, or may simply be worn as an undergarment.

Figure 6:
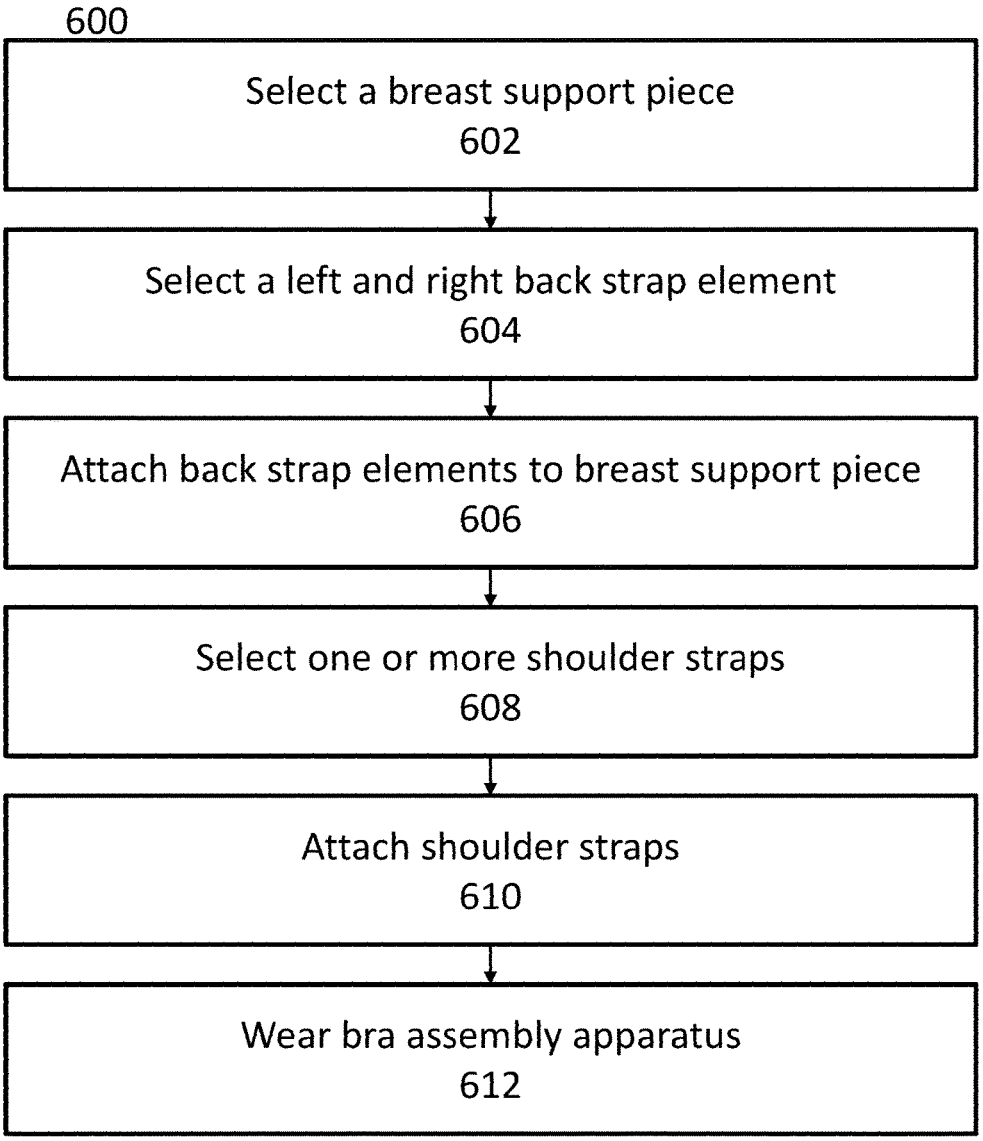
FIG. 6 shows an exemplary process flow diagram detailing a method by which a multi-sectional bra assembly apparatus may be assembled and worn.

Turning now to exemplary FIG. 6, FIG. 6 depicts an exemplary process flow diagram detailing a method 600 by which a multi-sectional bra assembly apparatus such as is shown in the foregoing figures may be assembled and worn. In a first step, a user may select a breast support piece 602. In some exemplary embodiments, a user may assemble a breast support piece; for example, in some exemplary embodiments, a breast support piece may be assembled from a frame structure and may have removable support cups that may be interchangeable with other support cups of different sizes, shapes, colors, materials, or styles, or having other attributes, which may allow a breast support piece to support a range of cup sizes. In other exemplary embodiments, a breast support piece may have removable and interchangeable side panels. Other components, such as, for example, an intermediary support band, may also be removable and may be interchangeable with similar components, as desired. In other exemplary embodiments, a breast support piece may be constructed as a single piece or fixed assembly of pieces, as desired.

In a next step, a user may select a left back strap element and a right back strap element 604. In some embodiments, a left back strap element and a right back strap element may be fixedly connected to one another; in other embodiments, a left back strap element and a right back strap element may be removably connectable to one another, such as by a seamless connector. In an embodiment, the left back strap element may be releasably connectable to the left side of the breast support piece, for example to one or more connectors disposed on the side panel of the left side of the breast support piece. Likewise, the right back strap element may be releasably connectable to the right side of the breast support piece, for example to one or more connectors disposed on the side panel of the right side of the breast support piece.

In a next step, a user may couple the left back strap element and the right back strap element to the breast support piece 606. In an embodiment, a user may couple the left back strap element and the right back strap element to different locations on the breast support piece based on their chest girth, which may allow multi-sectional bra assembly apparatus to support different sizes of chest girth.

For example, in an exemplary embodiment, the attachment elements that are disposed on the breast support piece, such as on the side panels of the chest support piece, may be arranged in rows, such as in a rectangular grid pattern or another pattern (such as a parallelogram pattern), as may be desired. According to such an exemplary embodiment, in a first case, a user desiring to configure a multi-sectional bra assembly apparatus to be worn with a larger chest girth may attach a left back strap element to an outer row (or set of rows) of attachment elements on the left side panel, and may attach a right back strap element to an outer row (or set of rows) of attachment elements on the right side panel. (The left and the right back strap elements may then be coupled to one another if not already coupled.) This may increase the allowable chest girth that may be accommodated by a fully assembled multi-sectional bra assembly apparatus. In a second case, a user desiring to configure a multi-sectional bra assembly apparatus to be worn with a smaller chest girth may attach a left back strap element to an inner row (or set of rows) of attachment elements on the left side panel, and may attach a right back strap element to an inner row (or set of rows) of attachment elements on the right side panel. This may decrease the allowable chest girth that may be accommodated by a fully assembled multi-sectional bra assembly apparatus. Sizes within this range of chest girths may also be selected, for example by selecting one or more intermediate rows on each side and connecting the back strap elements to these intermediate rows, as may be desired.

In a next step, a user may, if desired, select one or more shoulder straps to be coupled to the multi-sectional bra assembly apparatus 608. In an exemplary embodiment, a user may select one or more shoulder straps having a desired attribute, such as a desired color, material, or the like. In some embodiments, shoulder straps may be provided in different sizes, and a user may select a shoulder strap having a desired size. In other embodiments, shoulder straps may be adjustable in length, for example by the use of an adjustment clip that may function to hold a shoulder strap at a desired adjusted length when closed or allow adjustment of the shoulder strap when open.

In a next step, a user may couple the selected shoulder straps to the multi-sectional bra assembly apparatus 610. In some embodiments, shoulder straps may be provided with a connector on either end; in an embodiment, one of the ends of each shoulder strap may be connectable to a breast support piece, and the other of the ends of each shoulder strap may be connectable to a back strap, in each case by use of the connectors disposed on the shoulder straps. In some embodiments, if desired, a connector that is connectable to a back strap may be a different connector than one that is connectable to the breast support piece; in other exemplary embodiments, each connector may be of the same type. In other embodiments, connectors may be provided on the breast support piece and/or one or each of the back straps, as may be desired.

A user may then—after assembling the multi-sectional bra assembly apparatus—wear the bra assembly apparatus 612. In an exemplary embodiment, the user may be required to assemble all or part of the bra assembly apparatus around their own body, such that it is in a worn position when fully assembled; in another exemplary embodiment, a user may assemble some or all of the bra assembly apparatus off of their body, such that an extra step may be required to put the bra assembly apparatus on or take it off. In such an embodiment, a bra assembly apparatus may have a closure, such as a clasp or other connector, located on the front or back of the bra assembly apparatus and which may allow the bra assembly apparatus to be put on or taken off easily once assembled. In other exemplary embodiments, the bra assembly apparatus may be put on or taken off by locking or unlocking an existing closure; for example, a user may be able to take off the bra assembly apparatus by decoupling one or both of the back straps from the side panels, while still leaving the back straps indirectly connected to the breast support piece by a plurality of shoulder straps.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A multi-sectional bra assembly apparatus, comprising:

a breast support piece, the breast support piece comprising a left support cup and a right support cup, the left support cup coupled to the right support cup;

a left side panel and a right side panel, the left side panel attached to a left side of the breast support piece and the right side panel attached to a right side of the breast support piece;

a left back strap element and a right back strap element each having a first end and a second end, wherein the left back strap element is configured to be releasably connected, at a left attachment site comprising one or more attachment elements, to the left side panel at the first end of the left back strap element, and wherein the right back strap element is configured to be releasably connected, at a right attachment site comprising one or more attachment elements, to the right side panel at the first end of the right back strap element; and an intermediary support band, wherein the left support cup is coupled to the right support cup by the intermediary support band;

an underwire component, the underwire component extending circumferentially around a lower portion of the left support cup, through the intermediary support band, and circumferentially around a lower portion of the right support cup, wherein the second end of the left back strap element is configured to be connected to the second end of the right back strap element, and wherein the left side panel and the right side panel are attached to the breast support piece by connection with the underwire component.

2. The bra assembly apparatus of claim 1, wherein the second end of the left back strap element and the second end of the right back strap element are fixedly connected.

3. The bra assembly apparatus of claim 1, wherein the second end of the left back strap element and the second end of the right back strap element are releasably connected by a seamless closure.

4. The bra assembly apparatus of claim 1, wherein the left back strap element and the right back strap element are constructed from one of: a transparent or a translucent material.

5. The bra assembly apparatus of claim 1, wherein the left side panel and the right side panel are fixedly coupled to the intermediary support band, and wherein the left support cup and the right support cup are each removably coupled to the intermediary support band.

6. The bra assembly apparatus of claim 1, wherein the left side panel is fixedly coupled to the intermediary support band and to the left support cup, the right side panel is fixedly coupled to the intermediary support band and to the right support cup, and the intermediary support band is fixedly coupled to the left support cup and the right support cup.

7. The bra assembly apparatus of claim 6, further comprising a reinforced boundary formed around the periphery of the lower portion of the left support cup and around the periphery of the lower portion of the right support cup, the boundary providing a through passage through which the underwire component extends.

8. The bra assembly apparatus of claim 1, further comprising a reinforced boundary formed around a perimeter of each component of the breast support piece.

9. The bra assembly apparatus of claim 1, further comprising a left shoulder strap and a right shoulder strap, each having a first end and a second end, a first connector being disposed on the first end of each shoulder strap and a second connector being disposed on the second end of each shoulder strap;

wherein each of the left support cup and the right support cup comprises a shoulder strap first end receiving element, each of the shoulder strap first end receiving elements being configured to receive the first connector; and wherein each of the left back strap element and the right back strap element comprises a shoulder strap second end receiving element, each of the shoulder strap second end receiving elements being configured to receive the second connector.

10. The bra assembly apparatus of claim 9, wherein each of the shoulder strap second end receiving elements are disposed on an interior side of each of the left back strap element and the right back strap element.

11. The bra assembly apparatus of claim 9, wherein each of the left shoulder strap and the right shoulder strap further comprises an adjustment clip.

12. The bra assembly apparatus of claim 1, wherein the left attachment site further comprises at least four attachment elements disposed in at least two rows along a first direction vector and disposed in at least two rows along a second direction vector nonparallel to the first direction vector; and wherein the right attachment site further comprises at least four attachment elements disposed in at least two rows along a third direction vector and disposed in at least two rows along a fourth direction vector nonparallel to the third direction vector.

13. The bra assembly apparatus of claim 1, wherein each of the attachment elements comprises a hook and eye closure.

14. A method of using a multi-sectional bra assembly apparatus, the method comprising:

selecting a breast support piece configured to be supportive of a breast area of a user, the breast support piece comprising a left support cup and a right support cup, the left support cup coupled to the right support cup, the breast support piece further comprising a left side panel and a right side panel, the left side panel coupled to the left support cup and the right side panel coupled to the right support cup;

selecting a left back strap element and a right back strap element, the left back strap element and a right back strap element each having a first end and a second end, wherein the left back strap element is configured to be releasably connected, at a left attachment site comprising one or more attachment elements, to the left side panel at the first end of the left back strap element, and wherein the right back strap element is configured to be releasably connected, at a right attachment site comprising one or more attachment elements, to the right side panel at the first end of the right back strap element, wherein the second end of the left back strap element is connected to the second end of the right back strap element;

coupling the left back strap element to the left attachment site and coupling the right back strap element to the right attachment site; and wearing the assembled multi-sectional bra assembly apparatus, wherein the left support cup is coupled to the right support cup by an intermediary support band, and wherein the left side panel and the right side panel are attached to the breast support piece by connection with the underwire component that extends circumferentially around a lower portion of the left support cup, through the intermediary support band, and circumferentially around a lower portion of the right support cup.

15. The method of claim 14, wherein the step of selecting a left back strap element and a right back strap element comprises:

identifying an attribute of another garment, the attribute comprising one or more of a color, print, style, or fabric; and selecting a left back strap element and a right back strap element having the identified attribute.

16. The method of claim 14, wherein the breast support piece further comprises a left shoulder strap first end receiving element and a right shoulder strap first end receiving element, wherein the left back strap element further comprises a left shoulder strap second end receiving element, and wherein the right back strap element further comprises a right shoulder strap second end receiving element; and further comprising:

coupling a left shoulder strap having a first end and a second end to the left shoulder strap first end receiving element by a connector disposed on the first end of the left shoulder strap, and coupling the left shoulder strap to the left shoulder strap second end receiving element by a connector disposed on the second end of the left shoulder strap; and coupling a right shoulder strap having a first end and a second end to the right shoulder strap first end receiving element by a connector disposed on the first end of the right shoulder strap, and coupling the right shoulder strap to the right shoulder strap second end receiving element by a connector disposed on the second end of the right shoulder strap.

17. The method of claim 16, wherein each of the left shoulder strap and the right shoulder strap comprises an adjustment clip, and further comprising:

adjusting the left shoulder strap to a desired length and securing the left shoulder strap at the desired length by the adjustment clip of the left shoulder strap; and adjusting the right shoulder strap to a desired length and securing the right shoulder strap at the desired length by the adjustment clip of the right shoulder strap.

18. The method of claim 14, wherein the left attachment site further comprises at least four attachment elements disposed in at least two rows along a first direction vector extending horizontally along the left side panel and disposed in at least two rows along a second direction vector nonparallel to the first direction vector, and wherein the right attachment site further comprises at least four attachment elements disposed in at least two rows along a third direction vector extending horizontally along the right side panel and disposed in at least two rows along a fourth direction vector nonparallel to the third direction vector; and further comprising:

determining a chest girth measurement of the user;

selectively attaching the left back strap element to one or more of the rows along the first direction vector based on the chest girth measurement; and selectively attaching the right back strap element to one or more of the rows along the third direction vector based on the chest girth measurement.

* * * * *